US010737905B2

(12) United States Patent
Bhosale et al.

(10) Patent No.: US 10,737,905 B2
(45) Date of Patent: Aug. 11, 2020

(54) ANTI-LOCK BRAKING ARRANGEMENT FOR AN ELEVATOR AND METHOD FOR CONTROLLING SAME

(71) Applicant: Inventio AG, Hergiswil (CH)

(72) Inventors: Vishal Bhosale, Pune (IN); Shreyas Naikade, Pune (IN)

(73) Assignee: INVENTIO AG, Hergiswil, NW (CH)

( * ) Notice: Subject to any disclaimer, the term of this patent is extended or adjusted under 35 U.S.C. 154(b) by 353 days.

(21) Appl. No.: 15/751,184

(22) PCT Filed: Aug. 10, 2016

(86) PCT No.: PCT/EP2016/068994
§ 371 (c)(1),
(2) Date: Feb. 8, 2018

(87) PCT Pub. No.: WO2017/025545
PCT Pub. Date: Feb. 16, 2017

(65) Prior Publication Data

US 2018/0229969 A1 Aug. 16, 2018

(30) Foreign Application Priority Data

Aug. 12, 2015 (EP) ..... 15180814

(51) Int. Cl.
*B66B 5/18* (2006.01)
*B66B 1/32* (2006.01)
(Continued)

(52) U.S. Cl.
CPC ..... *B66B 5/18* (2013.01); *B66B 1/32* (2013.01); *B66B 5/044* (2013.01); *B66B 5/06* (2013.01)

(58) Field of Classification Search
CPC .. B66B 5/18; B66B 1/32; B66B 5/044; B66B 5/06
See application file for complete search history.

(56) References Cited

U.S. PATENT DOCUMENTS 4,989,921 A 2/1991 Vanzeyl
5,648,644 A * 7/1997 Nagel ..... B66B 5/18 187/288
(Continued)

FOREIGN PATENT DOCUMENTS

CN 102795524 A 11/2012
EP 2878562 A1 6/2015
(Continued)

*Primary Examiner* — Michael A Riegelman
(74) *Attorney, Agent, or Firm* — William J. Clemens; Shumaker, Loop & Kendrick, LLP

(57) ABSTRACT

A braking arrangement for an elevator arrangement includes a speed sensor arrangement for generating an over-speed signal of a moving component of the elevator arrangement, a hydraulic brake arrangement for generating a braking action of the moving component upon application of a hydraulic pressure and an actuator arrangement for generating and applying the hydraulic pressure to the hydraulic brake arrangement. The braking arrangement includes a control connected to the speed sensor arrangement and in response to the over-speed signal initiating an ABS braking process by controlling the actuator arrangement to repeatedly increase and decrease the hydraulic pressure to the hydraulic brake arrangement with a repetition time interval that is successively extended during the ABS braking process. The braking arrangement enables safe and reliable deceleration of the moving component, such as a car or a counterweight, while avoiding an excessive jerk by smoothly increasing the braking action.

18 Claims, 4 Drawing Sheets

(51) Int. Cl.
*B66B 5/04* (2006.01)
*B66B 5/06* (2006.01)

(56) References Cited

U.S. PATENT DOCUMENTS 5,969,303 A * 10/1999 Piserchia ..... B66B 1/28 187/288
6,056,088 A * 5/2000 Gerstenkorn ..... B66B 5/0031 187/390
6,193,026 B1 * 2/2001 Sevilleja ..... B60T 13/22 187/288
6,802,395 B1 * 10/2004 Helstrom ..... B66B 5/02 187/247
7,637,353 B2 * 12/2009 Shibata ..... B66B 1/308 187/286
7,896,136 B2 * 3/2011 Shibata ..... B66B 5/02 187/287
7,938,231 B2 * 5/2011 Ueda ..... B66B 5/02 187/288
9,457,987 B2 * 10/2016 Della Porta ..... B66B 1/32
2004/0189083 A1 * 9/2004 Nowak ..... B60T 17/18 303/15
2015/0136530 A1 * 5/2015 Rui ..... B66B 1/32 187/288
2016/0152441 A1 * 6/2016 Tschuppert ..... B66B 5/18 303/10
2016/0214834 A1 * 7/2016 Cunningham ..... B66B 5/18
2018/0229969 A1 * 8/2018 Bhosale ..... B66B 1/32

FOREIGN PATENT DOCUMENTS

JP 2011057316 A 3/2011
JP 2011105455 A 6/2011
JP 2011184141 A 9/2011
WO 2014177494 A1 11/2014

* cited by examiner

ANTI-LOCK BRAKING ARRANGEMENT FOR AN ELEVATOR AND METHOD FOR CONTROLLING SAME

FIELD

The present invention relates to a braking arrangement for an elevator arrangement. Furthermore, the invention relates to a method for controlling a braking arrangement, a computer program product for controlling such method and a computer-readable medium for storing such computer program product.

BACKGROUND

Elevators are used for transporting persons or items in a vertical direction. Moving components such as an elevator car or a counterweight may travel within an elevator shaft. As such moving components may travel along significant heights and may transport, inter alia, persons and therefore very strict security and safety requirements have to be fulfilled.

For example, if an elevator car gets into an over-speed condition whereby it exceeds a permissible speed during normal operation of the elevator, emergency braking actions have to be effected in order to securely avoid for example any damages or even injuries to passengers of the elevator. In an extreme case, e.g. a failure of an elevator engine or even a breakage of elevator suspension means, an emergency braking action has to be effected in order to securely avoid a drop or fall of the elevator car which could otherwise result in a fatal crash.

Various approaches for establishing a braking capability for an elevator arrangement have been proposed. Some of these approaches may also be used for emergency braking actions. Most of these conventional approaches use electromagnetic brakes in order to decelerate a moving component of an elevator arrangement. For example, Japanese document JP 2011-057316 A relates to an elevator with an emergency braking control function. JP 2011-184141 relates to an electromagnetic brake device and to a mechanism for particularly adjusting a braking force of the brake.

As an alternative, WO 2014/177494 A1 describes a hydraulic braking system for use in a passenger transport installation such as an elevator, an escalator or a moving walkway.

While such conventional braking arrangement may fulfil safety requirements for braking actions, i.e. may decelerate a moving component of an elevator arrangement which has come into an over-speed condition within a sufficiently short period of time, most of such conventional braking arrangement tend to exert an instantaneous jerk for example onto an elevator car upon such braking action. Such jerk may be inconvenient for a passenger accommodated within such car or may, in worst case, even harm such passenger.

Accordingly, there may be a need for a braking arrangement for an elevator arrangement avoiding such inconvenience or even harm. Particularly, there may be a need for a braking arrangement which may avoid significant jerk on an elevator's moving component as a result to a braking action, particularly an emergency braking action. Furthermore, there may be a need for a method for controlling a braking arrangement for an elevator arrangement fulfilling such requirements, for a computer program product enabling controlling such method and for a computer-readable medium storing such computer program product.

SUMMARY

According to a first aspect of the invention, a braking arrangement for an elevator is proposed. The braking arrangement comprises a speed sensor arrangement, a hydraulic brake arrangement, an actuator arrangement and a control. The speed sensor arrangement is adapted for generating an over-speed signal upon determining an over-speed of a moving component of the elevator arrangement, such moving component being for example an elevator car or a counterweight. The hydraulic brake arrangement is adapted for generating a braking action onto the moving component upon application of a hydraulic pressure. The actuator arrangement is adapted for generating and applying the hydraulic pressure to the hydraulic brake arrangement. The control is adapted for controlling the actuator arrangement. The control is connected to the speed sensor arrangement. Particularly, the control is adapted to, upon receiving the over-speed signal from the speed sensor arrangement, initiating and effecting an ABS (anti-lock braking system) braking process by controlling the actuator arrangement to repeatedly increase and decrease the hydraulic pressure to the hydraulic brake arrangement with a repetition time interval. Therein, the repetition time interval is successively extended during the ABS braking process.

Ideas underlying embodiments of the present invention may be interpreted as being based, inter alia and without restricting the scope of the invention, on the following observations and recognitions.

In order to enable a strong, fast and secure braking action for an elevator arrangement, a specific braking arrangement is proposed. The braking arrangement uses a hydraulic brake arrangement in order to generate a braking action onto a moving component of the elevator arrangement, i.e. for generating braking forces which may significantly decelerate the moving component in case of for example an over-speed condition. In such hydraulic brake arrangement, the braking action is initiated and effected upon application of a hydraulic pressure which may be generated by the actuator arrangement comprised in the braking arrangement. In combination, the hydraulic brake arrangement and the actuator arrangement enable a braking action in which sufficiently strong braking forces may be applied in sufficiently short times in order to secure safe deceleration of the moving component even in cases of e.g. emergency.

Such hydraulic brake arrangement and actuator arrangement may be particularly suitable for high-rise elevator arrangements in which, typically, large cars and/or heavy counterweights may travel along significant heights such as more than 50 m, 100 m or even 200 m, such that high requirements for braking actions have to be fulfilled.

In order to avoid excessive jerk, during a braking process, upon initiation of the braking action, the braking process is specifically adapted to reveal characteristics of an ABS braking process in which the braking action is applied in such manner that excessive jerk onto the moving component is avoided. For such ABS braking process, the actuator arrangement is controlled in a specific manner by repeatedly increasing and decreasing the hydraulic pressure provided to the hydraulic brake. Therein, the increasing of the hydraulic pressure and the decreasing of the hydraulic pressure is repeated in a specific repetition time interval. Specifically within the ABS braking process such repetition time interval is successively extended during the ABS braking process.

That is a duration during which the hydraulic pressure is increased before then being decreased again, is relatively short at the beginning of the ABS braking process and, with further progression of the braking process, such duration successively increases, i.e. becomes longer. Accordingly, the braking action onto the moving component which depends, inter alia, on the length of the braking duration at increased hydraulic pressure also increases over time. As a result, while the braking action onto the moving component is relatively small at the beginning of the ABS braking process, such braking action then becomes increasingly stronger until, eventually, the moving component is completely decelerated and stopped. In other words, the rate of deceleration of moving component is relatively small at the beginning of braking process and eventually increases as braking progresses with time.

Due to such braking action increasing over time, the ABS braking process may avoid excessive jerk onto the moving component while at the same time enabling sufficiently strong braking forces resulting in a relatively smooth but strong braking result which may finally safely stop the moving component.

According to an embodiment, the actuator arrangement is adapted to repeatedly increase and decrease the hydraulic pressure within a repetition time interval of less than 50 ms, preferably within a repetition time interval of less than 20 ms or 10 ms, even more preferably within a repetition time interval of less than 5 ms or 2 ms.

The actuator arrangement should be able to increase and decrease the hydraulic pressure applied to the hydraulic brake arrangement very quickly such that such pressure increase and decrease may be performed for example more than 20 times, preferably more than 100 times or even more than 500 times, per second. With such capacity of very rapidly increasing and decreasing the hydraulic pressure, an ABS braking process may be advantageously performed such that at a beginning of the ABS braking process, hydraulic pressure may be applied to the hydraulic brake arrangement for only very short durations of e.g. less than 10 ms or even less than 5 ms, whereas at a later stage of the ABS braking process, the hydraulic pressure may be applied for longer periods of for example more than 50 ms or even more than 100 ms or 0.5 s. With the options for adapting the hydraulic pressure during the ABS braking process very finely, a braking action may be adapted for a smooth but still very effective deceleration of the moving component of the elevator arrangement.

For example, in accordance with an embodiment of the present invention, the actuator arrangement comprises a piston and a motor, for example an electrical motor. Therein, the actuator arrangement is adapted to increase the hydraulic pressure by a stroke of the piston driven by the motor and to decrease the hydraulic pressure by a return stroke (or counter stroke) of the piston also driven by the motor.

In other words, the actuator arrangement may comprise a piston which, when driven within a stroke, increases the hydraulic pressure applied to the hydraulic brake arrangement. In a subsequent return stroke driven by the motor, the piston then again releases, i.e. decreases, the applied hydraulic pressure. In such way, the hydraulic pressure to the hydraulic brake arrangement may be increased and decreased very rapidly by suitably driving the piston using the motor.

Such actuator arrangement comprising a piston and a motor, particularly an electric motor, may be relatively cheap, reliable and robust.

According to an embodiment, the repetition time interval at least doubles during the ABS braking process. For example, the repetition time interval may increase during the ABS braking process by a factor of at least 2, a factor of at least 5, a factor of at least 10 or even more.

In other words, the control of the braking arrangement is adapted such that the repetition time interval in which the applied hydraulic pressure increases and decreases again before once more increasing in a subsequent repetition time interval is effected such that such repetition time interval is relatively short at a beginning of the ABS braking process and then at least doubles during the ABS braking process towards an end of such process. Preferably, the repetition time interval extends by at least a factor of 5, preferably by a factor of at least 10 or more during the ABS braking process. Due to such increase of the repetition time interval, a braking action at the beginning of the ABS braking process is relatively weak and then significantly increases in a course of the braking process such that the braking action smoothly but significantly increases from an initial low value to a substantially higher value.

According to an embodiment, the repetition time interval extends non-linearly.

In other words, the duration of the repetition time interval does not only increase in length in a linearly proportional manner with respect to a point in time within the ABS braking process but preferably increases in an over-linearly proportional manner. For example, the repetition time interval may increase in an exponential manner. With such non-linear extension of the repetition time interval, the corresponding braking action may also increase in a non-linear manner, i.e. braking forces for decelerating the moving component may be relatively weak at a beginning of the ABS braking process and may then increase non-linearly in the course of the ABS braking process before finally reaching a level at which the moving component is very significantly decelerated and finally stopped. As a result, smooth but effective deceleration of the moving component may be obtained.

According to an embodiment of the invention, a pattern with which the repetition time interval extends during the ABS braking process is predetermined.

In other words, a manner in which the repetition time interval successively gets longer during the ABS braking process is already predefined before the ABS braking process is actually initiated. For example, the pattern indicating a time-depending development of the repetition time interval may be stored in a memory within for example the braking arrangement. Upon generating a braking action, the actuator arrangement and the hydraulic brake arrangement may then be driven in accordance with such predefined pattern. A control controlling the actuator arrangement using such predefined pattern may be implemented easily and at low cost.

In an alternative embodiment, a pattern with which the repetition time interval extends during the ABS braking process is adapted based on a feedback signal indicating a current velocity of the moving component.

In other words, the pattern with which the control drives the actuator arrangement for increasing and decreasing the hydraulic pressure is not fixedly predefined but is specifically adapted taking into account for example a reaction or condition of the moving component. Therein, a feedback signal may be provided from a sensor or any other device, such feedback signal indicating the current velocity of the moving component to be decelerated by the braking arrangement. Accordingly, such feedback signal may indicate whether the moving component is already decelerating or is still accelerating and the repetition time interval for the ABS braking process may be adapted accordingly. For example, taking into account such feedback signal, the control may recognize whether the moving component's reaction to the intended braking action is sufficient or has to be increased for example by increasing braking forces by more rapidly extending the repetition time interval.

In a specific example, the control may learn from the feedback signal that for example an elevator car does not sufficiently quickly decelerate during the ABS braking process which may be for example a result of the car being heavily loaded. Based on such feedback signal, the control may then more rapidly increase the repetition time interval thereby also increasing the braking action onto the car in order to efficiently rapidly decelerate the car even in such heavily loaded condition. Optionally, a further signal can be fed to the control from a load sensor.

According to an embodiment, the feedback signal may be provided by the speed sensor arrangement.

In other words, the speed sensor arrangement may not only serve for detecting the over-speed of the moving component and correspondingly generating the over-speed signal but may further be adapted for determining a current velocity of the moving component and providing such information as a feedback signal to the control of the braking arrangement.

According to an embodiment of the present invention, the speed sensor arrangement comprises a roller and a detector arrangement, the roller being arranged and adapted for rotating upon motion of the moving component and the detector arrangement being arranged and adapted for detecting the roller's rotating motion. Preferably, the detector arrangement is adapted for detecting the roller's rotating motion in a non-contacting manner such as optically.

In other words, the speed sensor arrangement comprises a roller which is forced into a rotating motion when the moving component is moved. For example, the roller may be moved together with the moving component and may be pressed, for example using a spring, against a static component of the elevator arrangement such as a guide rail. When the roller is rotated upon motion of the moving component, such rotating motion may be detected by the detector arrangement in order to thereby derive information about the motion of the moving component, particularly about a velocity of the moving component or at least the fact, that the moving component exceeds a certain speed limit thereby coming into an over-speed condition.

Preferably, the detector arrangement is adapted for detecting the roller's rotating motion without mechanically contacting the roller, i.e. in a contactless manner. Thereby, for example any wear and/or mechanical damaging risks may be minimized and a reliability of the speed sensor arrangement may be increased.

For example, the detector arrangement may measure the roller's rotating motion optically by detecting optical characteristics which e.g. periodically vary upon rotating the roller. In a specific embodiment, a toothed wheel may be attached to the roller and optical reflectance characteristics or optical transmission characteristics through portions of such toothed wheel may be determined by the detector in order to thereby derive information about the rotating velocity of the toothed wheel and the rotating roller mechanically connected therewith.

According to an embodiment, the speed sensor arrangement is fixed to the moving component of the elevator arrangement.

In other words, the speed sensor arrangement is directly attached to the moving component the velocity of which it shall determine. Accordingly, the speed sensor arrangement moves together with the moving component. For example, the speed sensor arrangement may be attached to an elevator car and may therefore directly and reliably measure the car's actual velocity within an elevator shaft for example relatively to static components within the elevator shaft such as guide rails installed in the elevator shaft. Accordingly, an actual over-speed condition of the moving component may be reliably determined as the speed sensor arrangement is directly connected to the moving component and is not only indirectly measuring the moving component's velocity for example via being connected to a suspension member which itself is connected to the moving component and which, in a worst case scenario, may lose contact to the moving component.

According to an embodiment, the hydraulic brake arrangement comprises at least one brake pad and one brake cylinder which, upon application of the hydraulic pressure, presses the brake pad against a static component of the elevator arrangement. For example, such static component may be a guide rail for guiding the moving component of the elevator arrangement during its motion.

In other words, the hydraulic brake arrangement may comprise one brake pad or preferably at least two brake pads and one or more brake cylinders. The brake pad may sometimes also be referred to as friction disk. The brake pad(s) may be actuated by the brake cylinder(s) in order to establish a mechanical contact and pressure of the brake pad against the static component such as the guide rail. As the brake pad(s) are typically made of a higher friction material, upon such mechanical contact, high braking forces may be induced for generating the braking action onto the moving component.

Preferably, the hydraulic brake arrangement is adapted such that, upon activation of the hydraulic brake arrangement, its brake pad(s) are pressed against portions of at least one of the guide rails typically comprised within an elevator shaft. Such guide rails typically have a smooth surface, are mechanically stable and are fixedly mounted within the elevator shaft such that they may act as a braking surface for interaction with the brake pad(s) of the hydraulic brake arrangement.

According to an embodiment, the hydraulic brake arrangement is fixed to the moving component of the elevator arrangement.

In other words, the hydraulic brake arrangement is preferably directly attached to the moving component such that it moves together with the moving component. Therein, preferably, the hydraulic brake arrangement is attached to the moving component in such a manner that forces applied to the hydraulic brake arrangement during a braking process may be directly and reliably transferred to the moving component in order to thereby decelerate the moving component. For example, the hydraulic brake arrangement can be fixed to the moving component using mechanically stable fixing means such as screws, bolts, rivets, welding, etc. Accordingly, a braking action provided by the hydraulic brake arrangement may directly act onto the moving component thereby enabling high reliability of the braking arrangement.

In an alternative approach, the hydraulic brake arrangement could also be provided such as to indirectly interact with the moving component, for example via a suspension member supporting the moving component. For example, the hydraulic brake arrangement could be attached to a traction sheave moving such suspension member and thereby indirectly interacting with the moving component. However, in such alternative arrangement, for example in case of a failure of the suspension member, no application of a braking action may be performed using the hydraulic brake arrangement.

According to a second aspect of the present invention, a method for controlling a braking arrangement for an elevator arrangement is proposed. Therein, the braking arrangement comprises essentially the same features as described herein with respect to the first aspect of the invention. The method comprises: upon receiving the over-speed signal from the sensor arrangement, initiating an ABS braking process by controlling the actuator arrangement to repeatedly increase and decrease the hydraulic pressure to the hydraulic brake with a repetition time interval, wherein the repetition time interval is successively extended during the ABS braking process.

Using such method and applying it to a suitably adapted braking arrangement, an ABS braking process may be realized which may significantly reduce any jerk onto a moving component upon decelerating the moving component for example in case of an emergency braking process.

According to a third aspect, a computer program product is described. Such computer program product comprises computer-readable instructions which are adapted to, when executed by a processor of e.g. a programmable control, controlling the method according to the above described second aspect of the invention.

Such computer program product may comprise computer-readable instructions in any programming language. The instructions may instruct the programmable elevator control to control monitoring a speed sensor arrangement and possibly acquiring an over-speed signal from the speed sensor arrangement. Furthermore, the elevator control may be instructed to control activating the actuator arrangement and the hydraulic brake arrangement such as to perform the described ABS braking process with repeatedly increasing and decreasing hydraulic pressures and with repetition time intervals successively increasing in duration in the course of the braking process.

According to a fourth aspect of the present invention, a computer-readable medium comprising a computer program product according to the above-mentioned third aspect of the invention stored thereon is suggested.

Such computer-readable medium may be any physical memory which allows storing computer-readable instructions and/or which enables downloading of such computer-readable instructions. For example, the computer-readable medium may be a CD, a DVD, flash memory, EPROM, parts of the internet providing download options or similar.

It shall be noted that possible features and advantages of embodiments of the invention are described herein partly with respect to a braking arrangement and partly with respect to a method for controlling such braking arrangement. A skilled person will recognize that features described for one embodiment may be suitably transferred, adapted, or modified for application with other embodiments and/or may be combined and/or replaced with other features described for other embodiments in order to come to further embodiments of the invention.

DESCRIPTION OF THE DRAWINGS

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Figure 1:
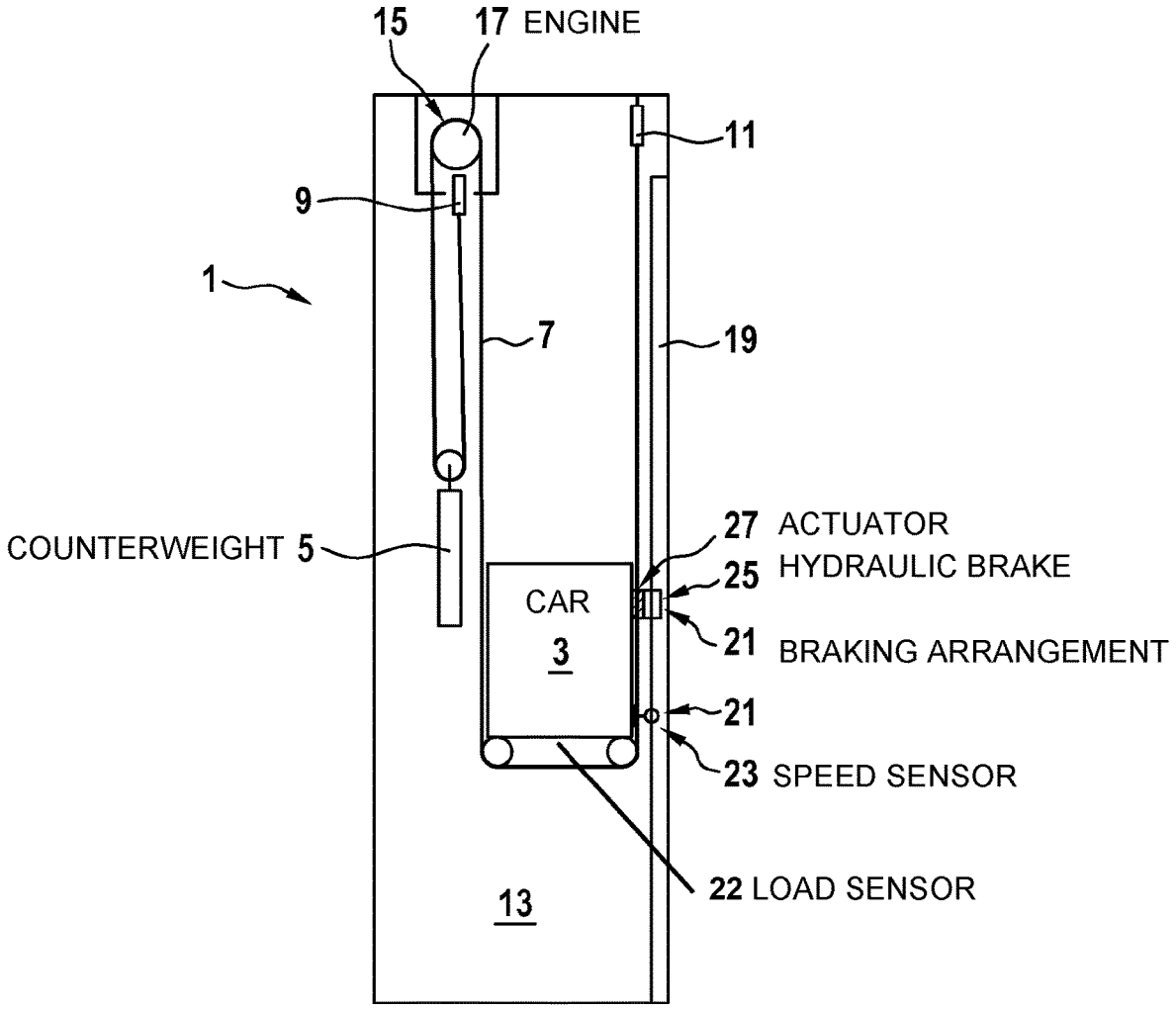
FIG. 1 shows an elevator arrangement.

FIG. 1 shows an elevator arrangement 1 in which a braking arrangement according to an embodiment of the present invention may be applied. The elevator arrangement 1 comprises two moving components 3, 5. A first moving component 3 is an elevator car, a second moving component 5 is a counterweight. Both moving components 3, 5 are supported by a suspension means 7 which may be for example one or more ropes or belts. Ends of the suspension means 7 are fixed to fixation structures 9, 11 at a top of an elevator shaft 13. The suspension means 7 may be moved by a traction sheave 15 driven by an engine 17 such that both moving components 3, 5 may be displaced vertically and in opposite directions within the elevator shaft 13. Conventionally, it is common practice to provide a load sensor 22 either in the car 3 (as in the current example) or at the rope fixation structures 9, 11 to determine whether an overload condition develops for example if too many passengers try to board the elevator car 3 from a given landing. If such an overload occurs an alarm generally sounds in the car 3 and the elevator 1 is prevented from moving until the loading of the car 3 is within the permitted thresholds.

During travel, the moving components 3, 5 are typically guided by one or more guide rails 19 which may be attached for example to walls of the elevator shaft 13 or to the brackets which are attached to the walls. Such guide rails 19 may be mechanically stable metal profiles having for example a T-shaped cross-section such that guide rollers or guide shoes attached the moving components 3, 5 may roll or slide along the guide rails 19.

In order to be able to fulfil safety requirements, one or more braking arrangements 21 may be included into the elevator arrangement 1. In accordance with an embodiment of the present invention, such braking arrangement comprises a speed sensor arrangement 23, a hydraulic brake arrangement 25 and an actuator arrangement 27. Furthermore, a controller is provided for controlling the actuator arrangement 27 to thereby enabling controlling a braking process for decelerating the moving component 3, 5 for example in case of an emergency.

Details of an embodiment of the braking arrangement 21 will be described with reference to FIG. 2.

The speed sensor arrangement 23 is adapted for measuring a velocity of at least one of the moving components 3, 5. At least, an over-speed condition of the moving component 3, 5 shall be detectable by the speed sensor arrangement 23 which, thereupon, generates an over-speed signal. This over-speed signal indicates that the monitored moving component 3, 5 exceeds a predetermined speed limit such that it may be in an over-speed condition which may be potentially dangerous.

Such information about the occurrence of an over-speed condition is transmitted to the control 29 of the elevator arrangement 1 by submitting a specific over-speed signal.

Upon receiving such over-speed signal, the control 29 controls the actuator arrangement 27 such that hydraulic pressure is generated and applied to the hydraulic brake arrangement 25. For such purpose, the actuator arrangement 27 comprises a motor 39 such as an electric motor via which a master cylinder 33 connected to the hydraulic brake arrangement 25 may be actuated. For example, the actuator arrangement 27 comprises a piston (not shown) and the electric motor 39 allows consistent actuation times as little as only a few milliseconds of variance in cycle times. The master cylinder 33 comprises a piston and spring arrangement 35. Furthermore, the master cylinder 33 is connected to a hydraulic reservoir 37 via for example two ports, i.e. an inlet port 36 and a compensating port 38. During operation, hydraulic fluid may flow through or into the reservoir 37 based on operating conditions during a braking process.

An outlet of the master cylinder 33 is connected via one or more hydraulic fluid lines 31 to one or more brake cylinders 41. Each brake cylinder 41 comprises one or more brake pads 43. In the example of FIG. 1, each brake cylinder 41 comprises two brake pads 43 arranged at opposite sides inside the brake cylinder 41 such that a portion of the T-shaped guide rail 19 lies in between the two brake pads 43. Furthermore, the brake pads 43 of a brake cylinder 41 are connected with each other via a caliper 45.

Upon an application of hydraulic pressure through the hydraulic fluid lines 31 to the brake cylinder 41, the brake pads 43 are pressed into mechanical contact with the intermittently arranged portion of the guide rail 19 forming a static component within the elevator arrangement. As the brake pads 43 are typically made of a high friction material, pressing the brake pads 43 into mechanical contact with the intermittently arranged portion of the guide rail 19 will generally result in a braking action onto a moving component 3, 5 to which the hydraulic brake arrangement 25 is attached.

However, in order to avoid excessively high braking forces acting onto the moving component 3, 5 upon initiating a braking process, which excessive braking forces could otherwise result in excessive jerk onto the moving component 3, 5, the hydraulic pressure applied to the hydraulic brake arrangement 25 is not abruptly raised to a maximum level. Instead, the control 29, upon receiving the over-speed signal from the speed sensor arrangement 23, progressively increases a braking action generated by the hydraulic brake arrangement by initiating a specific braking process which is called herein ABS braking process.

For such purpose, the control 29 controls the actuator arrangement 27 such as to repeatedly increase and decrease the hydraulic pressure to the hydraulic brake arrangement 25. Therein, the control 29 extends a repetition time interval during the ABS braking process. This may mean that the variable velocity motor 39 presses and releases the piston 35 of the master cylinder 33 in very short time intervals at the beginning of the ABS braking process whereas, successively, the time intervals with which the piston 35 is pressed and released will gradually increase in the course of the ABS braking process. In other words, a stroke with the piston 35 and a return-stroke thereof may follow each other at short time intervals at the beginning of the ABS braking process and such stroke, and optionally also the release in the return-stroke, may become longer and longer during the progression of the ABS braking process.

Accordingly, with the repetition of increasing and decreasing hydraulic pressure onto the hydraulic brake arrangement 35 and successively increasing repetition time intervals, the ABS braking process starts with a relatively low braking action and may then quickly but smoothly increase the braking action by increasing the high pressure time intervals applied to the hydraulic brake arrangement.

In other words, due to an increase/decrease in hydraulic pressure, the brake pads 43 of the brake cylinders 41 will get repeatedly engaged and disengaged against a surface of the guide rail 19, thereby causing braking and brake release actions which will reduce the velocity of the moving component 3, 5. A velocity of the actuator piston will reduce as the braking/brake-releasing continues. With reduced velocity of the actuator piston, a time for braking action, i.e. the braking pads 43 being pressed against the guide rails 19, will increase. Eventually, this frictional force between the brake pads 43 and the guide rails 19 will bring the moving component 3, 5 to stop.

Figure 5:
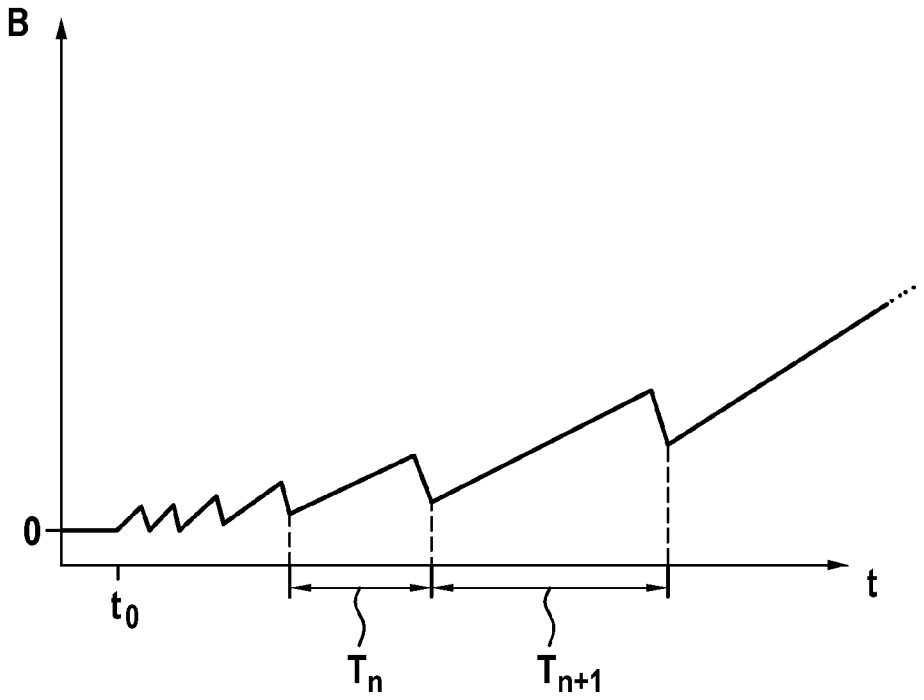
FIG. 5 visualized a time-dependent development of a braking action realized with a braking arrangement according to an embodiment of the present invention.

FIG. 5 shows a schematic diagram illustrating the development over time t of the braking action B during an ABS braking process effected by the braking arrangement 21 according to an embodiment of the present invention.

An over-speed of the moving component 3, 5 is detected at the point in time $t_0$. Upon receiving the corresponding over-speed signal from the speed sensor arrangement 23, the control 29 initiates the ABS braking process by controlling the actuator arrangement 27 to increase the hydraulic pressure applied to the hydraulic brake arrangement 25. However, this hydraulic pressure is not increased up to a maximum value and held there but, instead, already after a very short time period of for example only a few milliseconds, the hydraulic pressure is already released again, for example by reversing a stroke of the actuator arrangement's 27 motor 39 to a counter-stroke. Such increase and decrease of the hydraulic pressure applied to the hydraulic brake arrangement 25 is repeated many times.

However, the repetition time interval $T_n$ is not held constant but increases successively during the ABS braking process. In other words, a repetition time interval $T_n$ is shorter than a succeeding repetition time interval $T_{n+1}$. Due to such increasingly long repetition time intervals $T_n$, a braking action generated by the hydraulic brake arrangement 25 and therefore a deceleration of the moving component 3, 5 successively increases over time.

Therein, a pattern or time development with which the repetition time intervals $T_n$ are successively extended during the ABS braking process may follow a predetermined pattern, i.e. may be independent of actual conditions for example within the elevator arrangement 1 and/or the braking arrangement 21.

Alternatively, a pattern with which the repetition time intervals $T_n$ extend during the ABS braking process may be adapted based on a feedback signal indicating a current velocity of the moving component, such feedback signal being provided for example by the speed sensor arrangement 23. Accordingly, with such feedback option, the control 29 may control the actuator arrangement 27 such that the braking action generated by the hydraulic brake arrangement 25 may be adapted for example as the speed of the moving component 3, 5 reduces. In other words, based on signals from the speed sensor arrangement 23 a real-time feedback signal may be provided to the control 29 which, in turn, may control for example the variable velocity of the actuator piston within the actuator arrangement 27.

Figure 2:
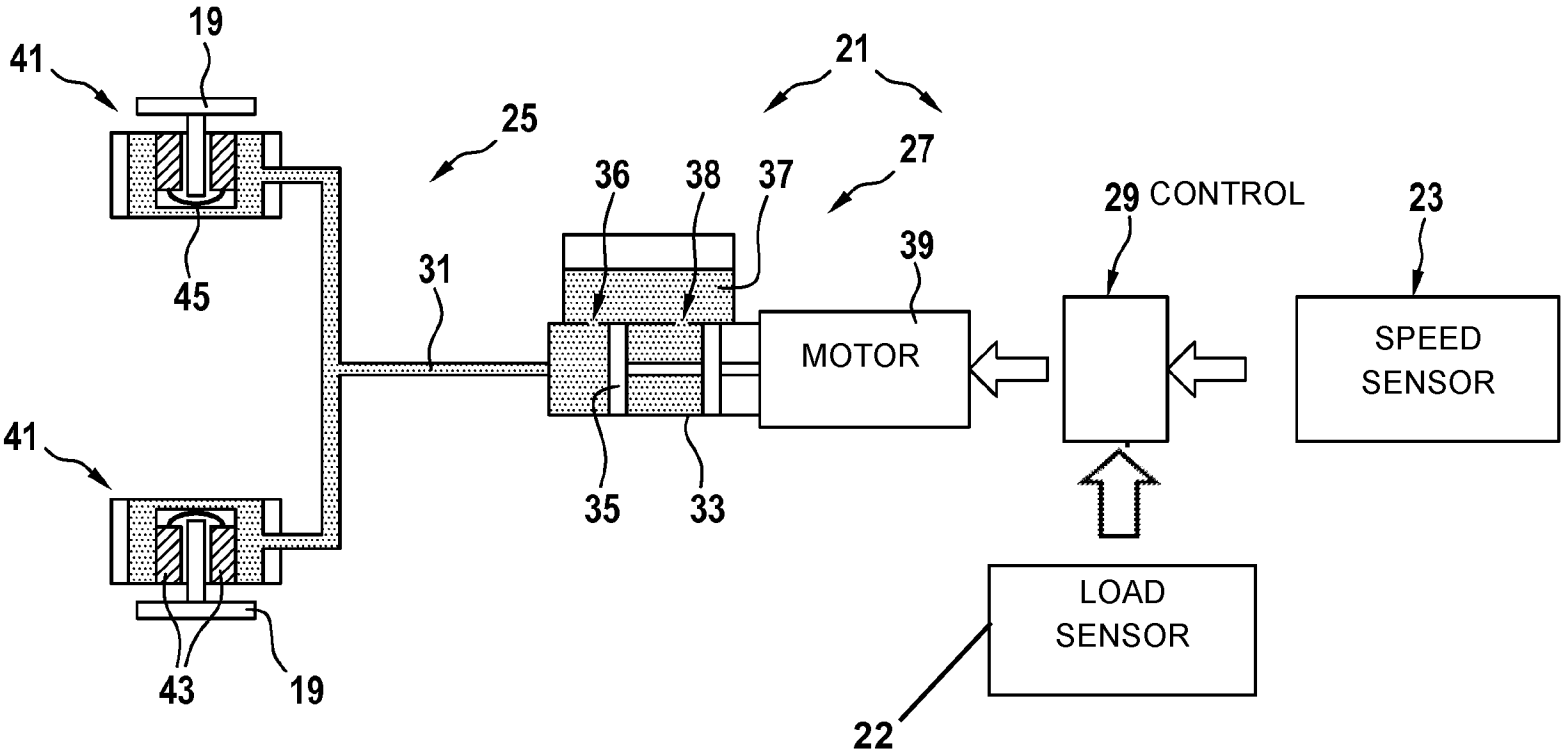
FIG. 2 shows a principle view of a braking arrangement according to an embodiment of the present invention.

Furthermore, as shown in FIG. 2, a signal representing the actual load within the car 3 derived from load sensor 22 can also be fed into the control 29. In this case the control 29 can additionally determine the actual load unbalance between the moving components 3, 5. Using the load signal from the load sensor 22 and the velocity signal from the speed sensor arrangement 23, the control 29 can instruct an appropriate braking action to be delivered by actuator arrangement 27. For example, if the control 29 determines that the car 3 is heavily loaded and travelling downwards at a high speed it can instruct a stronger braking action. On the contrary, if the control 29 determines that the car 3 is unloaded and travelling downwards at low speed, it can instruct weaker braking action.

Figure 3:
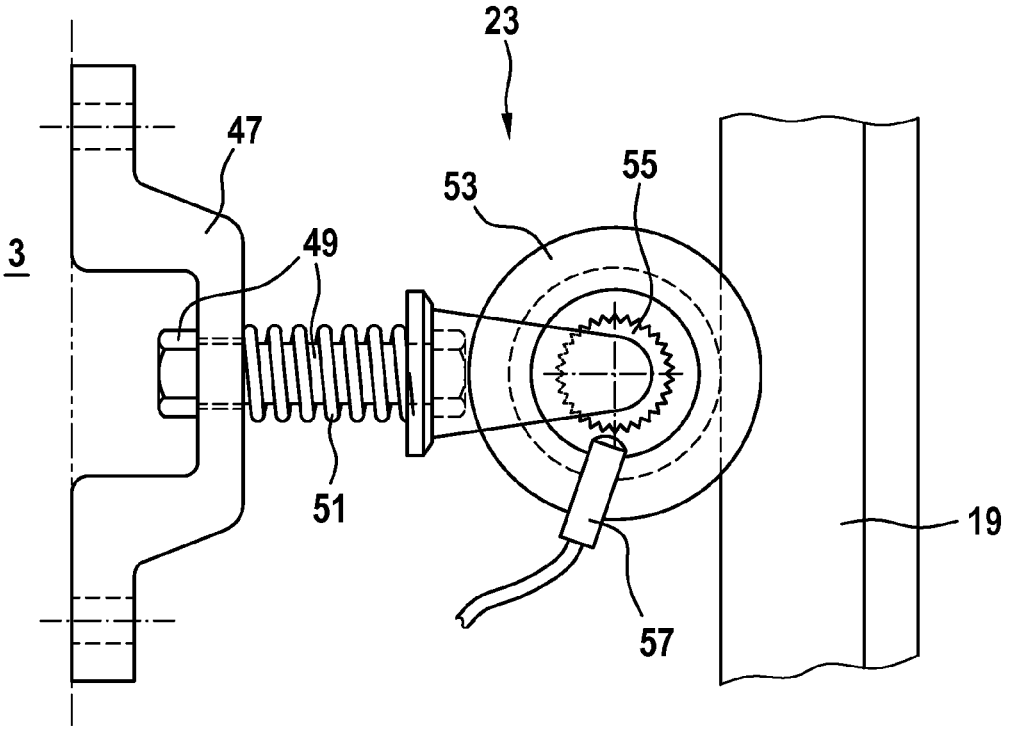
FIG. 3 shows a side view of a speed sensor arrangement for a braking arrangement according to an embodiment of the present invention.
Figure 4:
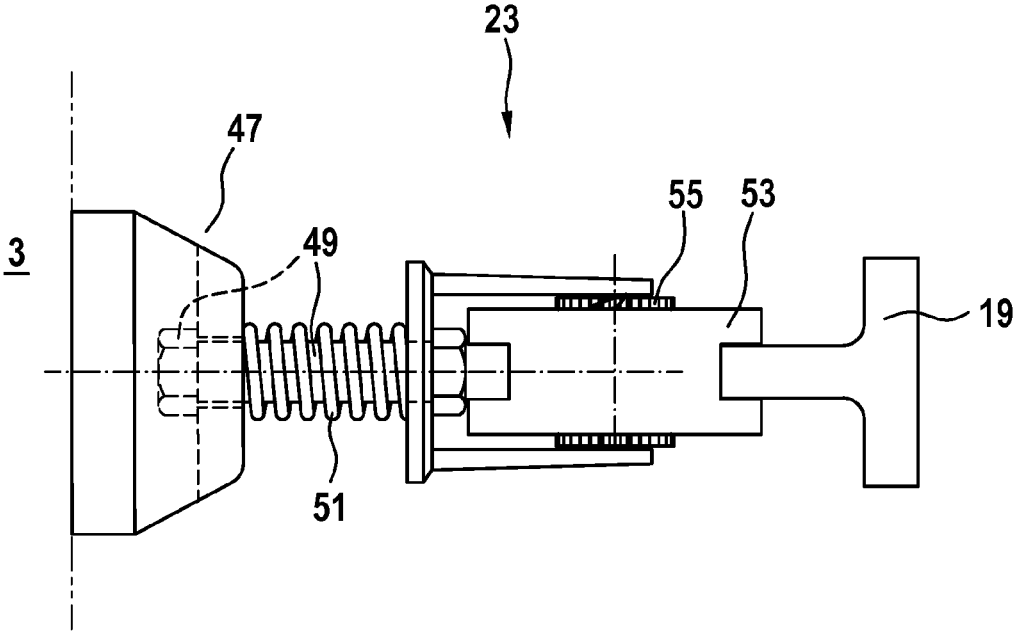
FIG. 4 shows a top view onto the speed sensor arrangement of FIG. 3.

FIGS. 3 and 4 show a side view and a top view onto a speed sensor arrangement 23 which may be used for a braking arrangement 21 according to an embodiment of the present invention.

The speed sensor arrangement 23 is fixedly attached to the moving component 3, 5 such as for example to a body of an elevator car. For example, a mounting housing 47 may be screwed, bolted, welded or fixed in other ways to the moving component 3, 5. The speed sensor arrangement 23 may comprise a spring loaded roller 53 which is pressed against a static component within the elevator arrangement 1 such as for example to the guide rail 19 such that it rotates upon moving the moving component 3, 5. For such purpose, the roller 53 is attached to the mounting housing 47 via a screw spring arrangement including a screw 49 and a spring 51 such as to keep the roller 53 tensioned against the guide rail 19.

In the example shown in FIGS. 3 and 4, a toothed wheel 55 is connected to the roller 53 such that it rotates together with the roller 53. The rotation of such toothed wheel 55 may be detected with a speed sensor 57. Preferably, such speed sensor 57 determines the rotation velocity of the toothed wheel 55 contactlessly. For example, the speed sensor 57 may comprise an optical detector such as a photodiode. Such optical detector may detect optical characteristics such as optical reflectance variations or optical transmission variations upon rotation of the toothed wheel 55 and a signal indicating the rotation velocity of the toothed wheel 55 may be derived therefrom.

It may be noted that, while the exemplary speed sensor arrangement 23 shown in FIGS. 3 and 4 may be advantageous in that it enables continuous reliable velocity detection for the moving component 3, 5, various other examples of speed sensor arrangements may be applied for determining an over-speed condition of the moving component and generating the over-speed signal.

Finally, it should be noted that terms such as "comprising" do not exclude other elements or steps and that term such as "a" or "an" do not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A braking arrangement for an elevator arrangement, comprising:

a speed sensor arrangement for generating an over-speed signal upon detecting an over-speed of a moving component of the elevator arrangement;

a hydraulic brake arrangement for generating a braking action of the moving component upon application of a hydraulic pressure;

an actuator arrangement for generating and applying the hydraulic pressure to the hydraulic brake arrangement;

a control for controlling the actuator arrangement, the control being connected to the speed sensor arrangement; and wherein the control, upon receiving the over-speed signal from the speed sensor arrangement, initiates an ABS braking process by controlling the actuator arrangement to repeatedly increase and decrease the hydraulic pressure to the hydraulic brake arrangement with a repetition time interval, wherein the repetition time interval is successively extended by the control during the ABS braking process.

2. The braking arrangement according to claim 1 wherein the actuator arrangement repeatedly increases and decreases the hydraulic pressure within the repetition time interval being of less than 50 ms.

3. The braking arrangement according to claim 1 wherein the actuator arrangement includes a piston and a motor and wherein the actuator arrangement increases the hydraulic pressure by a stroke of the piston driven by the motor and decreases the hydraulic pressure by a return stroke of the piston driven by the motor.

4. The braking arrangement according to claim 1 wherein the control at least doubles the repetition time interval during the ABS braking process.

5. The braking arrangement according to claim 1 wherein the repetition time interval extends non-linearly.

6. The braking arrangement according to claim 1 wherein a pattern with which the repetition time interval extends during the ABS braking process is predetermined.

7. The braking arrangement according to claim 1 wherein a pattern with which the repetition time interval extends during the ABS braking process is based on a feedback signal to the control indicating a current velocity of the moving component.

8. The braking arrangement according to claim 7 wherein the feedback signal is provided by the speed sensor arrangement.

9. The braking arrangement according to claim 1 wherein the speed sensor arrangement includes a roller and a detector, the roller being arranged and adapted for rotating upon motion of the moving component and the detector being arranged and adapted for detecting rotating motion of the roller.

10. The braking arrangement according to claim 9 wherein the detector detects the rotating motion of the roller contactlessly.

11. The braking arrangement according to claim 9 wherein the detector is an optical detector.

12. The braking arrangement according to claim 1 wherein the speed sensor arrangement is fixed to the moving component of the elevator arrangement.

13. The braking arrangement according to claim 1 wherein the hydraulic brake arrangement includes at least one brake pad and a brake cylinder that, upon application of the hydraulic pressure, presses the at least one brake pad against a static component of the elevator arrangement.

14. The braking arrangement according to claim 13 wherein the static component of the elevator arrangement is a guide rail for guiding the moving component during its motion.

15. The braking arrangement according to claim 1 wherein the hydraulic brake arrangement is fixed to the moving component of the elevator arrangement.

16. A method for controlling a braking arrangement for an elevator arrangement comprising the steps of:

operating a speed sensor arrangement to generate an over-speed signal upon detecting an over-speed of a moving component of the elevator arrangement;

operating a hydraulic brake arrangement to generate a braking action of the moving component upon application of a hydraulic pressure;

operating an actuator arrangement to generate and apply the hydraulic pressure to the hydraulic brake arrangement; and initiating an ABS braking process, upon receiving the over-speed signal from the speed sensor arrangement, by controlling the actuator arrangement to repeatedly increase and decrease the hydraulic pressure to the hydraulic brake arrangement with a repetition time interval, wherein the repetition time interval is successively extended during the ABS braking process.

17. A computer program product comprising computer readable instructions which are adapted to, when executed by a programmable control, perform the method according to claim 16.

18. A non-transitory computer readable medium comprising the computer program product according to claim 17 stored thereon.

* * * * *